US010092117B2

(12) United States Patent
Hughes

(10) Patent No.: US 10,092,117 B2
(45) Date of Patent: Oct. 9, 2018

(54) CASCADING DISPLAY

(71) Applicant: AVERY DENNISON RETAIL INFORMATION SERVICES, LLC, Westborough, MA (US)

(72) Inventor: Caroline Hughes, Nottingham (GB)

(73) Assignee: AVERY DENISON RETAIL INFORMATION SERVICES, LLC, Mentor, OH (US)

( * ) Notice: Subject to any disclaimer, the term of this patent is extended or adjusted under 35 U.S.C. 154(b) by 0 days.

(21) Appl. No.: 15/460,877

(22) Filed: Mar. 16, 2017

(65) Prior Publication Data

US 2017/0265656 A1 Sep. 21, 2017

Related U.S. Application Data

(60) Provisional application No. 62/309,213, filed on Mar. 16, 2016.

(51) Int. Cl.

| | |
|---|---|
| ***A47B 43/00*** | (2006.01) |
| ***A47F 7/10*** | (2006.01) |
| ***A47F 5/08*** | (2006.01) |
| ***A47F 5/00*** | (2006.01) |
| ***A47F 5/11*** | (2006.01) |
| ***A47F 10/00*** | (2006.01) |

(52) U.S. Cl.

CPC ..... *A47F 7/10* (2013.01); *A47F 5/0018* (2013.01); *A47F 5/08* (2013.01); *A47F 5/116* (2013.01); *A47F 10/00* (2013.01); *A47B 43/00* (2013.01); *A47F 2010/005* (2013.01)

(58) Field of Classification Search

CPC .. A47F 7/10; A47F 5/08; A47F 5/0018; A47F 5/116; A47F 5/11; A47F 5/112; A47F 10/00; A47F 2010/005; A47B 43/00

USPC ..... 108/92, 134, 135, 157.14, 93, 97, 99, 108/100, 101; 211/128.1, 130.1, 118, 85, 211/104, 149, 132.1, 73, 72, 59.1, 57.1; 229/117.18, 117.22

See application file for complete search history.

(56) References Cited

U.S. PATENT DOCUMENTS

| | | | | | |
|---|---|---|---|---|---|
| 192,560 | A * | 7/1877 | Bowden | A47L 19/04 | 211/104 |
| 507,233 | A * | 10/1893 | Marshalll | A47F 5/13 | 108/99 |
| 731,710 | A * | 6/1903 | Renken | A47B 73/00 | 211/128.1 |
| 892,238 | A * | 6/1908 | Fay | A47F 5/116 | 211/132.1 |
| 1,303,185 | A * | 5/1919 | Eichling | A47F 5/10 | 211/128.1 |
| 1,422,529 | A * | 7/1922 | Bingaman | A47F 5/11 | 40/312 |
| 1,460,185 | A * | 6/1923 | Webster | A47F 7/145 | 206/741 |

(Continued)

*Primary Examiner* — Jonathan Liu
*Assistant Examiner* — Devin K Barnett
(74) *Attorney, Agent, or Firm* — Avery Dennison Retail Information Services, LLC

(57) ABSTRACT

An improved cascading display can be formed by assembling a plurality of support members integrally formed from the display. The improved display can attractively exhibit socks, underwear, and other displayable garments in a cascading fashion and can require fewer materials. Methods of forming the cascading displays are also disclosed.

14 Claims, 8 Drawing Sheets

(56) References Cited

U.S. PATENT DOCUMENTS 1,576,283 A * 3/1926 Johnson ..... A47F 5/10 211/126.16
1,698,686 A * 1/1929 Ziemmerman ..... A47F 5/116 108/100
1,711,877 A * 5/1929 Drehmann ..... A47F 5/112 206/464
1,715,237 A * 5/1929 Huston ..... A47F 5/112 40/661.08
1,729,014 A * 9/1929 Scherotto ..... A47F 5/116 211/49.1
1,747,981 A * 2/1930 Marsh ..... A47F 5/116 108/100
1,802,123 A * 4/1931 Mohen ..... A47F 5/116 206/740
1,881,986 A * 10/1932 Webster ..... A47F 5/112 211/72
1,886,532 A * 11/1932 Davidson ..... A47F 5/116 211/135
1,925,673 A * 9/1933 Potter ..... A47F 5/116 108/100
1,955,769 A * 4/1934 Reynolds ..... G09F 5/02 108/99
1,961,394 A * 6/1934 Rothe ..... A47B 31/04 211/130.1
1,964,880 A * 7/1934 Katz ..... A47F 5/116 108/100
2,062,165 A * 11/1936 Davidson ..... A47F 5/112 211/135
2,089,958 A * 8/1937 Hothersall ..... B65D 5/12 206/806
2,097,553 A * 11/1937 Gruenberg ..... A47F 5/112 211/135
2,108,122 A * 2/1938 Hall ..... A47B 57/00 211/128.1
2,110,034 A * 3/1938 Bales ..... A47F 5/10 108/156
2,135,533 A * 11/1938 Ringler ..... A47F 5/112 206/740
2,283,301 A * 5/1942 Waddell ..... A47F 5/0018 211/128.1
2,292,932 A * 8/1942 Edwards ..... A47F 5/112 211/126.16
D196,160 S * 8/1963 Patterson ..... 108/99
3,139,192 A * 6/1964 Maguire ..... G09F 5/00 211/135
D204,041 S * 3/1966 Berger ..... D6/683.1
3,390,810 A * 7/1968 Schnceweiss ..... B65D 5/4612 206/167
3,777,897 A * 12/1973 Gray ..... A47F 7/145 211/128.1
D232,992 S * 10/1974 Molzen ..... D6/570
4,080,907 A * 3/1978 Kaufman ..... A47B 55/00 108/59
4,355,758 A * 10/1982 Lavery ..... B65D 5/4204 206/777
D276,009 S * 10/1984 Ousley ..... D6/525
4,493,424 A * 1/1985 Smith ..... A47F 5/116 108/165
4,506,790 A * 3/1985 Muscari ..... A47F 5/116 108/180
4,537,316 A * 8/1985 Simon ..... A47F 5/0025 211/133.3
4,903,847 A * 2/1990 Duffy ..... A47B 63/00 211/187
4,982,848 A * 1/1991 Church ..... A47F 5/08 211/128.1
5,040,688 A * 8/1991 Martin ..... A47F 7/145 211/128.1
D321,615 S * 11/1991 Lavine ..... D6/675.1
5,209,386 A * 5/1993 Allison ..... B60R 7/043 220/529
5,213,220 A * 5/1993 McBride ..... A47B 43/00 211/126.16
D361,454 S * 8/1995 Compton ..... D6/675.3
D363,840 S * 11/1995 Weshler ..... D6/683.1
5,465,851 A * 11/1995 Smith ..... A47F 5/11 108/162
5,489,062 A * 2/1996 Wagner ..... B65D 5/2047 229/117.18
D373,698 S * 9/1996 Farrell ..... D6/570
5,564,566 A * 10/1996 Lamb ..... B25H 3/00 206/349
5,678,492 A * 10/1997 Pinkstone ..... A47F 5/116 108/165
5,706,959 A * 1/1998 Smith ..... A47F 5/0018 108/165
5,826,732 A * 10/1998 Ragsdale ..... A47F 5/116 108/165
5,947,307 A * 9/1999 Battaglia ..... A47F 5/13 108/108
5,996,822 A * 12/1999 Hopkins ..... A47B 67/02 108/92
D426,403 S * 6/2000 Chumley ..... D6/683.1
6,098,820 A * 8/2000 Smith ..... A47F 5/116 211/132.1
6,378,710 B1 * 4/2002 Grueneberg ..... A47F 5/116 211/132.1
D458,640 S * 6/2002 Hofman ..... D19/75
6,736,267 B2 * 5/2004 Schamante ..... B65D 73/0092 206/703
6,871,750 B2 * 3/2005 Moss ..... A47F 7/145 211/149
6,929,133 B1 * 8/2005 Knapp, III ..... A47F 5/0807 211/118
7,007,615 B2 * 3/2006 Grueneberg ..... A47F 5/116 108/165
7,111,743 B1 * 9/2006 Moss ..... A47F 5/116 211/130.1
7,537,121 B2 * 5/2009 Markson ..... B65D 5/5266 206/741
7,571,820 B2 * 8/2009 Alexander ..... A47F 5/116 211/73
7,753,218 B2 * 7/2010 Moss ..... A47F 5/116 211/133.3
D637,024 S * 5/2011 Noble Colin ..... D6/705.7
8,631,979 B1 * 1/2014 Reahard ..... A47G 25/743 211/118
9,009,997 B1 * 4/2015 Kemp ..... G09F 7/18 211/55
D736,014 S * 8/2015 Tsai ..... D6/675.2
2003/0160015 A1 * 8/2003 Broerman ..... A47F 5/116 211/149
2007/0022644 A1 * 2/2007 Lynch ..... A47B 13/08 40/446
2008/0000858 A1 * 1/2008 Fenerty ..... A47F 5/116 211/90.01
2008/0046345 A1 * 2/2008 Serre ..... G06Q 10/087 705/28
2008/0083682 A1 * 4/2008 Moss ..... A47F 5/116 211/72
2008/0265726 A1 * 10/2008 Sheffer ..... A47B 47/06 312/259
2009/0031628 A1 * 2/2009 Lee ..... A47F 5/10 47/66.6
2009/0050589 A1 * 2/2009 Pedler ..... A47B 43/00 211/85.8
2009/0101698 A1 * 4/2009 Chen ..... B65D 5/4204 229/117.18
2010/0072150 A1 * 3/2010 Takashima ..... A47F 5/0025 211/59.3
2014/0217047 A1 * 8/2014 Frost ..... B65H 45/12 211/135
2014/0230295 A1 * 8/2014 Hawkins ..... A47F 5/0025 40/606.03
2015/0150373 A1 * 6/2015 Stenhouse ..... A47B 43/00 211/149

(56) References Cited

U.S. PATENT DOCUMENTS

| | | | | |
|---|---|---|---|---|
| 2015/0203266 | A1* | 7/2015 | Wu | B65D 75/22 206/471 |
| 2015/0265050 | A1* | 9/2015 | Linares | A47B 96/021 206/386 |
| 2016/0135618 | A1* | 5/2016 | Alvarez | A47F 1/08 211/59.2 |
| 2017/0076343 | A1* | 3/2017 | Bernstein | G06Q 30/0601 |

* cited by examiner

CASCADING DISPLAY

CROSS REFERENCE TO RELATED APPLICATION(S)

The present application claims priority to and the benefit of U.S. Provisional Patent Application No. 62/309,213 filed on Mar. 16, 2016, which is incorporated herein by reference.

TECHNICAL FIELD

The present disclosure generally relates to garment displays which are attractive, environmentally friendly, and require reduced amounts of material to construct.

BACKGROUND

Prior to purchase, consumers generally prefer to inspect socks, underwear, and other displayable garments to evaluate their design, quality, and feel. Certain displays, such as cascading sock displays, can facilitate such inspection by allowing a consumer to see and touch each pair of socks sold in a set prior to purchase. However, traditional garment displays suffer from a number of undesirable attributes including unattractive designs and excessive material usage. It would therefore be desirable to provide an improved display that can attractively display socks, underwear, and other displayable garments prior to sale that is easily assembled and environmentally friendly.

SUMMARY

In accordance with one embodiment, a cascading sock display includes a front face, a back face, and a cascade support structure. The cascade support structure includes a plurality of integrally formed sock support structures. Each of the plurality of integrally formed sock support structures is vertically spaced apart along the front face and displaced away from the front face. Each of the plurality of integrally formed sock support structures is displaced farther away from the front face than each of the preceding sock support structures.

In accordance with another embodiment, a method of assembling a cascading sock display includes providing a cascade support structure and folding a plurality of integrally formed distally extending members to form a plurality of sock support structures. The cascade support structure includes the plurality of integrally formed distally extending members. Each of the integrally formed distally extending members is vertically spaced apart. Each of the plurality of sock support members is spaced farther away from a front face of the cascading sock display than preceding sock support structures.

In accordance with another embodiment, a cascade support structure includes a substantially flat sheet of material including longitudinal edges and a plurality of integrally formed distally extending members vertically spaced apart.

In accordance with another embodiment, a cascading display for displaying a plurality of undergarments comprises a front face and a cascading support structure integrally formed with and extending therefrom. The cascading support structure comprises at least one pair of integrally formed extending members each for retaining and displaying an undergarment, and a display portion.

DETAILED DESCRIPTION

An improved cascading display that can attractively display multiple pairs of socks, underwear, and other displayable garments is disclosed. The improved display is environmentally friendly, can require less material than comparative displays, and can be quickly modified to suit the needs of particular stores and consumers. Generally, such improved display can include a cascade support structure which can simultaneously support and exhibit multiple pairs of socks, underwear, and other displayable garments.

Figure 1:
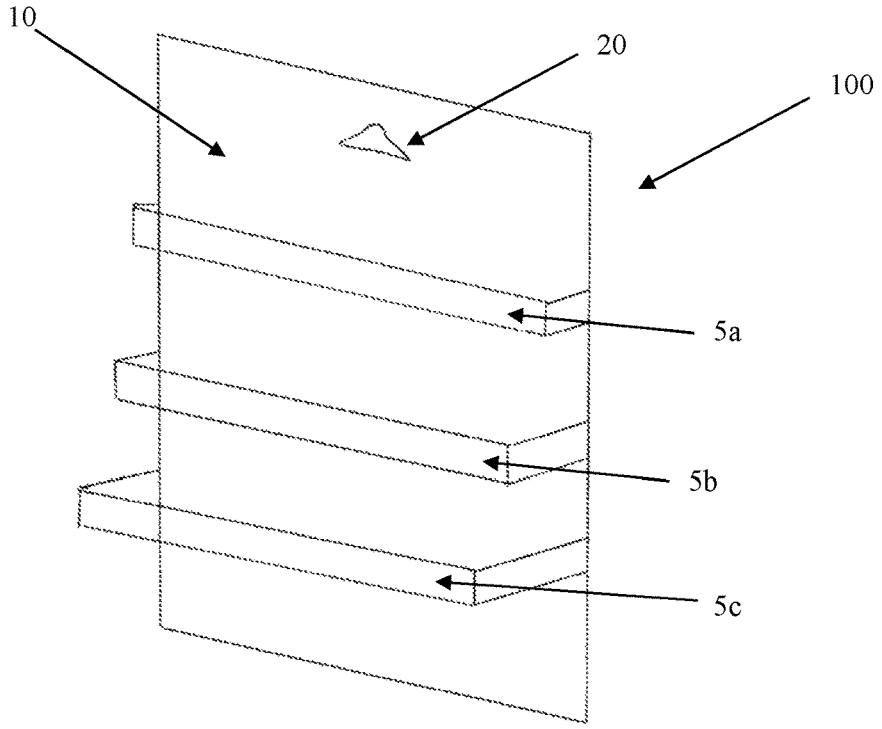
FIG. 1 depicts a perspective view of a cascading sock display according to one embodiment.
Figure 2:
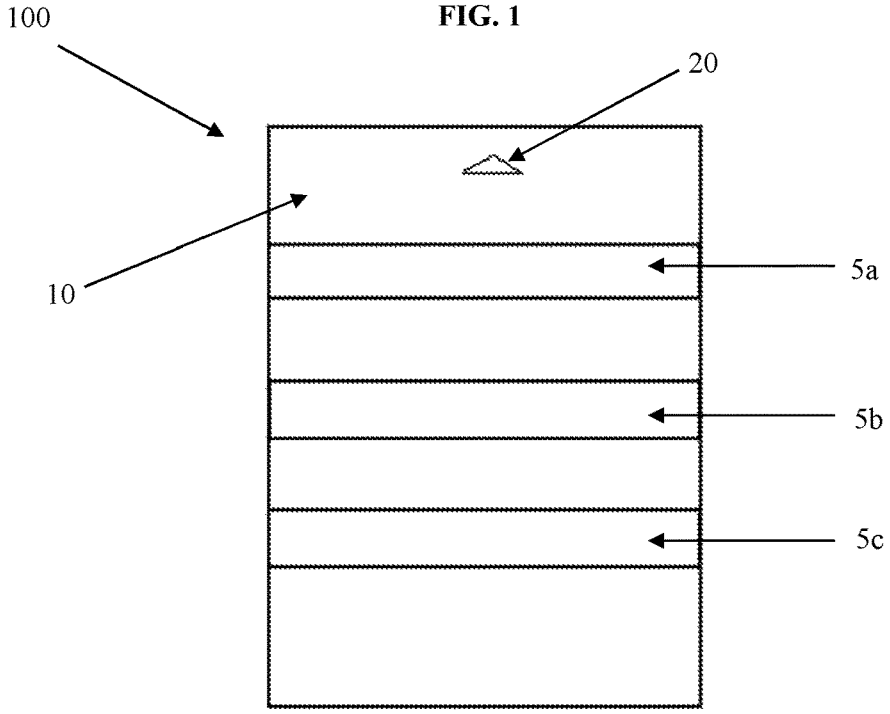
FIG. 2 depicts a side view of the cascading sock display depicted in FIG. 1.
Figure 3:
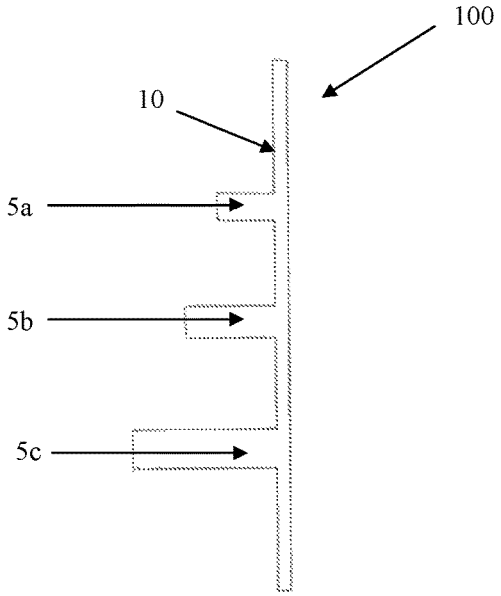
FIG. 3 depicts a front view of the cascading sock display depicted in FIGS. 1 and 2.

An illustrative example of a cascade support structure 100 is depicted in FIGS. 1, 2, and 3 which respectively illustrate perspective, side, and front views of a cascade support structure 100 including three sock support structures 5*a*, 5*b*, and 5*c*. Each of the sock support structures 5*a*, 5*b*, and 5*c* can support a pair of socks. The sock support structures 5*a*, 5*b*, and 5*c* are arranged to display at least a portion of every pair of socks in the improved sock display. The cascade design can allow consumers to quickly evaluate the aesthetics and quality of each of the socks sold in the improved sock display without physical manipulation of the display.

As illustrated by the different projection views in FIGS. 1 to 3, each of the sock support structures 5*a*, 5*b*, and 5*c* can be distally spaced away from a front face 10 of the cascade support structure 100. Additionally, each of the sock support structures can be vertically spaced apart the front face 10.

Distal spacing of the sock support structures 5*a*, 5*b*, and 5*c* from the front face 10 can form volumes for socks included in the sock display to hang from. To allow for sock pairs to overlie preceding sock pairs, each of the sock support structures 5*a*, 5*b*, and 5*c* can be distally spaced farther away from the front face 10 than the preceding sock structure. For example, sock support structure 5*b* can be distally displaced farther away from the front face 10 of the cascade support structure 100 than sock support structure 5*a*.

In combination with distal spacing, vertical spacing of each of the sock support structures 5*a*, 5*b*, and 5*c* along the front face 10 can allow an improved sock display to exhibit socks in a cascading nature with each pair of socks overlying a preceding pair of socks. Vertical spacing can ensure that at least a portion of each sock pair is viewable to a consumer with the amount of vertical space between each sock support structure 5*a*, 5*b*, and 5*c* determining how much of each sock pair is viewable.

As can be appreciated, the number of sock support structures (e.g., 5*a*, 5*b*, and 5*c* in FIGS. 1 to 3) in an improved sock display can vary depending on the number of socks to be displayed. For example, in certain embodiments, a cascade support structure 100 can include only two sock support structures 5*a* and 5*b*. However, in other certain embodiments, a cascade support structure 100 can include a greater number of sock support structures and can include, for example, five sock support structures (not depicted) or even seven or more sock support structures (not depicted). Generally, the maximum number of sock support structures in an improved sock display can be limited only by the resulting height of the sock display and any aesthetic concerns.

According to certain embodiments, the width of each sock support structure 5*a*, 5*b*, and 5*c* can be about the width of a sock. Such widths can allow a pair of socks to be attractively displayed without wrinkling or folding of the socks. As can be appreciated however, other widths are also possible. For example, the width of each sock support structure 5 can alternatively be an integer multiple of a sock width such as two or three sock widths. In such embodiments, multiple pairs of socks can attractively be hung adjacent to one another and can be displayed on a single sock support structure. Increased sock support structure widths can be useful to exhibit relatively large quantities of socks without requiring the improved sock display to have a large vertical height or be at risk of toppling.

The sock support structures can generally vary in both materials and formation. For example, in certain embodiments, the sock support structures can be integrally formed from the cascade support structure 100. As used herein, integrally formed can mean the structures were formed from a single piece of material. For example, a cascade support structure with integrally formed sock support structures can mean both the cascade support structure and the sock support structures are formed from a single sheet of material. As can be appreciated, structures that are integrally formed can eliminate waste material inherent to comparative designs that require mechanical attachment of additional components.

Figure 4:
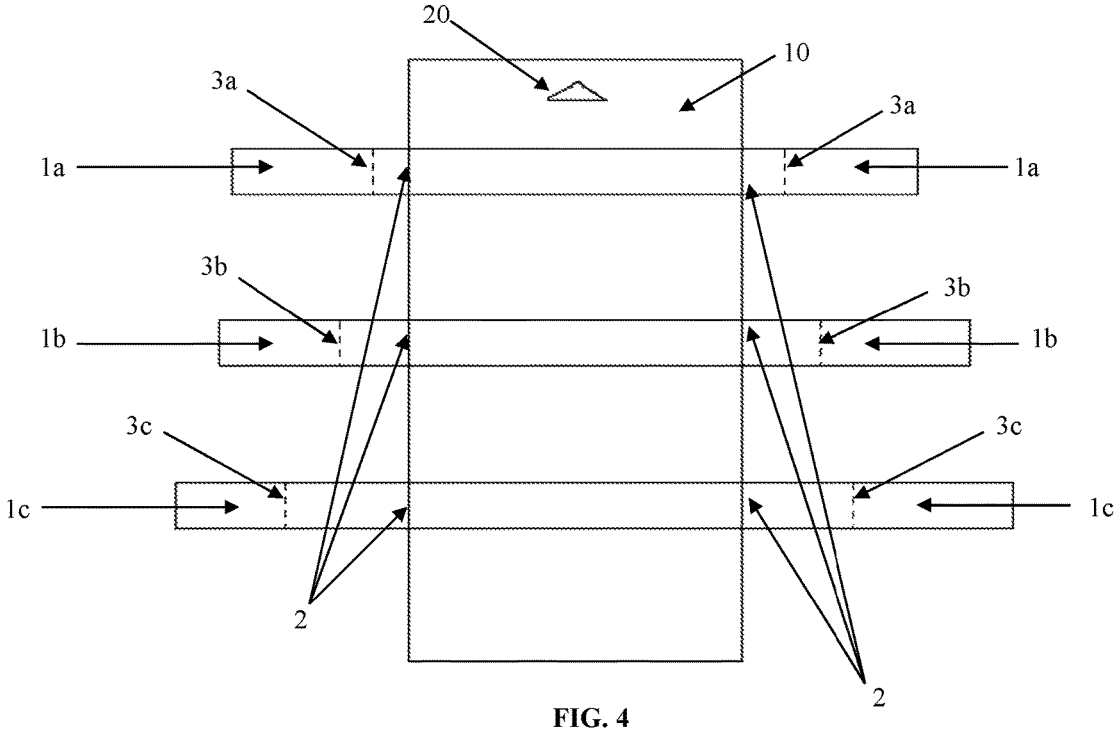
FIG. 4 depicts a front view of an unassembled cascade structure according to one embodiment.

An example of such an embodiment is illustrated by FIG. 4 which depicts an unassembled and substantially flat cascade support structure 100 including a plurality of integrally formed distally extending members 1*a*, 1*b*, and 1*c*. As depicted, corresponding pairs of distally extending members 1*a*, 1*b*, and 1*c* can be folded and attached to one another to respectively assemble the sock support structures 5*a*, 5*b*, and 5*c* previously depicted in FIGS. 1 to 3.

Generally, two folds are necessary to form the sock support structures 5*a*, 5*b*, and 5*c* from the distally extending members 1*a*, 1*b*, and 1*c*. First, each of the distally extending portions 1*a*, 1*b*, and 1*c* can be folded along edge 2 to extend the distally extending portions 1*a*, 1*b*, and 1*c* away from the front face 10 of the cascade support structure 100. Second, the distally extending portions 1*a*, 1*b*, and 1*c* can then be folded at a second location 3*a*, 3*b*, and 3*c* to cause the corresponding pairs 1*a*, 1*b*, and 1*c* to overlap over the front face 10.

The location of the second fold 3*a*, 3*b*, and 3*c* can vary for each distally extending member 1*a*, 1*b*, and 1*c*. As can be appreciated, the location of the second fold 3*a*, 3*b*, and 3*c* can determine the distance the assembled sock support structure is spaced away from the front face 10. In certain embodiments, the distance between edge 2 and second fold location 3*a*, 3*b*, and 3*c* can generally match the thickness of a pair of hanging socks with each successive second fold location 3*a*, 3*b*, and 3*c* further including the thickness of a pair of socks hung on the preceding sock support structure. As can be appreciated, the distance of the second fold location 3*a*, 3*b*, and 3*c* can also be further increased in certain embodiments such as when, for example, a pair of socks is folded twice and the sock support structure needs to accommodate the greater volume required for the additional fold.

Figure 5:
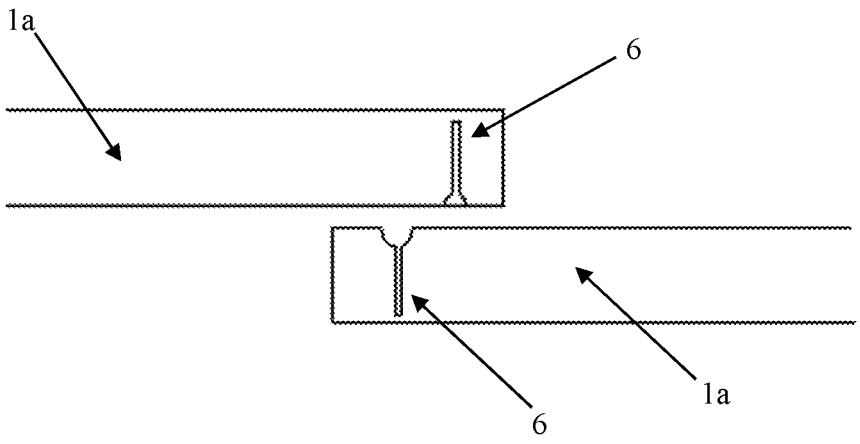
FIG. 5 depicts a detailed front view of a sock support structure according to one embodiment.

When the distally extending members 1*a*, 1*b*, and 1*c* of FIG. 4 are folded, each distally extending member 1*a*, 1*b*, and 1*c* can overlap with a corresponding distally extending member 1*a*, 1*b*, and 1*c* extending from the opposite side of the cascade support structure 100. The corresponding distally extending members 1*a*, 1*b*, and 1*c* can be attached to the corresponding member to form sock support structures 5*a*, 5*b*, and 5*c*. Although any suitable attachment process can be effective including adhesives, mechanical fasteners, and hook and loop fasteners, it can be particularly advantageous to mechanically join the corresponding members together without additional materials. For example, each of the corresponding distally extending members 1*a*, 1*b*, and 1*c* can include one or more slotted sections 6 as depicted in FIG. 5. Secure attachment can be made in such embodiments by sliding the corresponding member 1*a*, 1*b*, or 1*c* into the one or more slotted sections 6 of the other corresponding member. As can be appreciated, other direct attachment methods are also possible. For example, in certain embodiments, one of the distally extending members can include a hole and the corresponding distally extending member can then be inserted into the hole. Direct attachment of the distally extending members can simplify the construction of an improved sock display, minimize the volume of materials required, and can allow for easier recycling.

Sock support structures 5*a*, 5*b*, and 5*c* can alternatively be formed by including distally extending members 1*a*, 1*b*, and 1*c* on only a single side of a cascade support structure 100. In such embodiments, the distally extending members 1*a*, 1*b*, and 1*c* can be of about twice the length as the distally extending members depicted in FIG. 4. Such distally extending members can form sock support structures by folding the members to create a sock support structure and then attaching the free end of the member to the distal side of the cascade support structure.

As can be appreciated, many variations to an improved sock display are possible. For example, in certain embodiments, an improved sock display can alternatively be formed of a cascading support structure and a backing structure. The use of two structures can allow for additional features in a sock display. For example, an improved sock display including a cascading structure and a backing structure can further include a display portion. Additionally, while this embodiment of the cascade support structure 100 has been described with respect to displaying socks, this is not meant as a limitation as the sock support structures 5*a*, 5*b*, and 5*c* may also be used to retain and display any other type of garment that is displayable.

Figure 6:
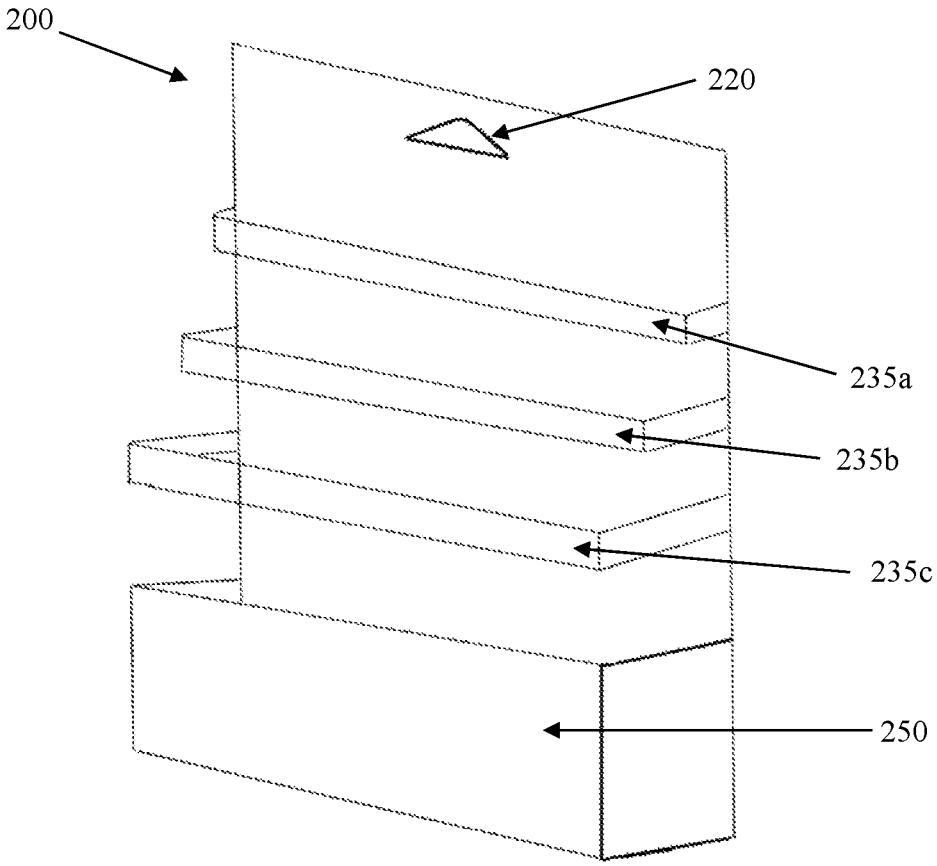
FIG. 6 depicts a perspective view of a cascading sock display according to one embodiment.
Figure 7:
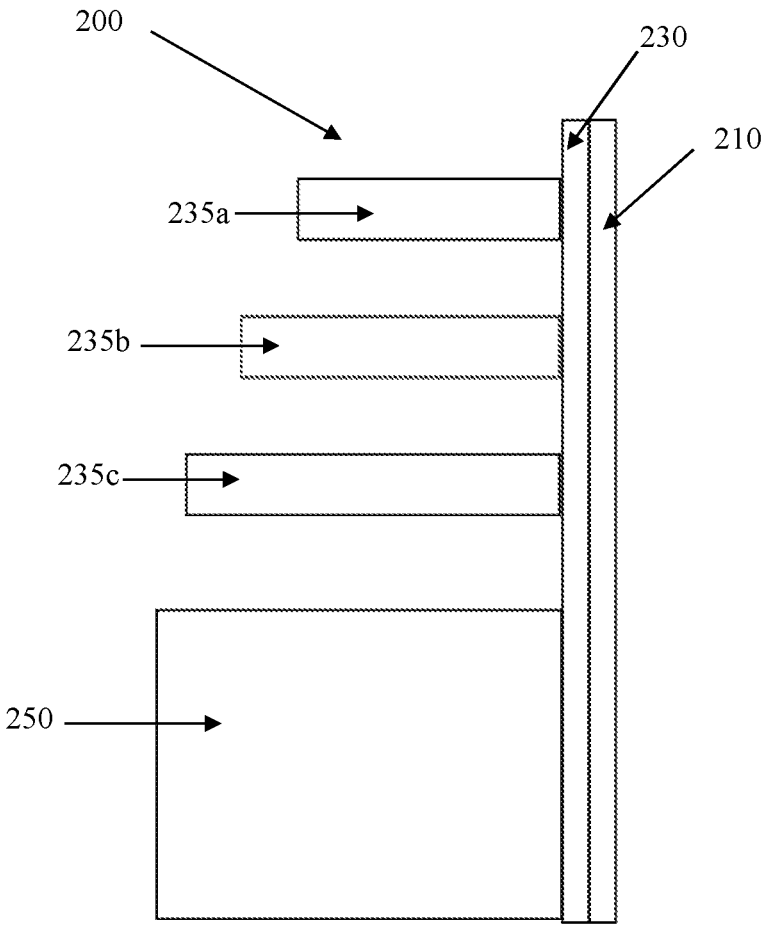
FIG. 7 depicts a side view of the cascading sock display depicted in FIG. 6.
Figure 8:
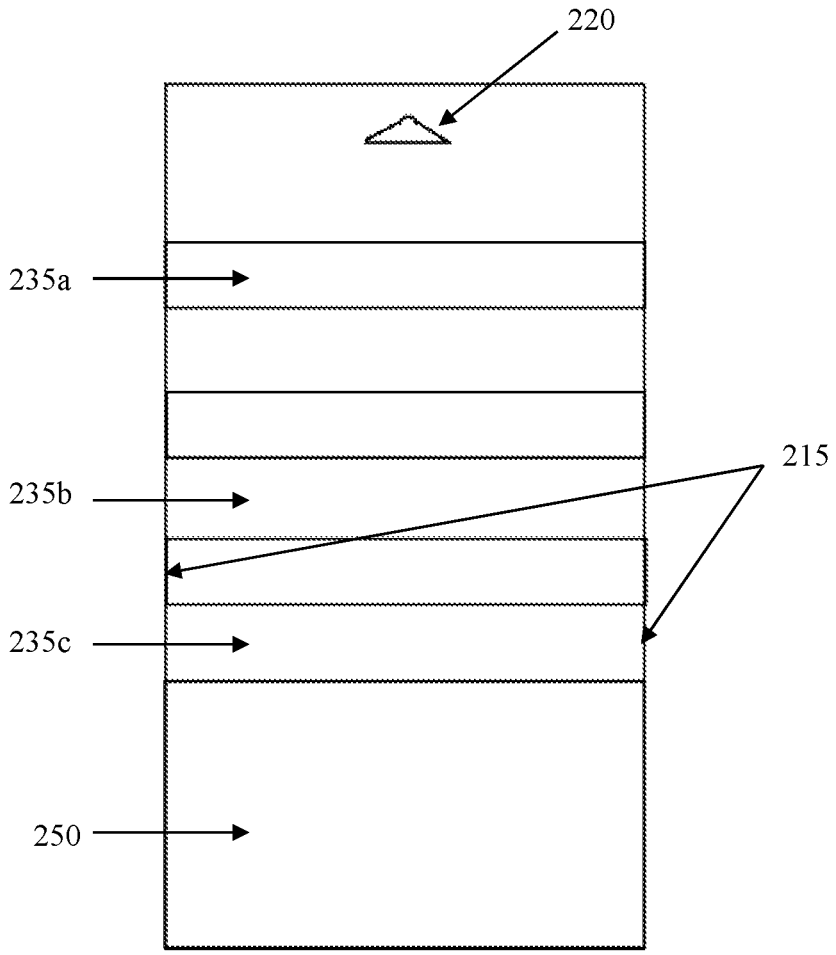
FIG. 8 depicts a front view of the cascading sock display depicted in FIGS. 6 and 7.

FIG. 6 depicts a perspective view of an improved sock display 200 including a display portion 250. As depicted in FIG. 6, the improved sock display 200 can be similar in appearance to the cascade support structure 100 depicted in FIG. 1 but can further include a display portion 250 at the bottom of the sock display 200. The display portion 250 can exhibit indicia, provide additional protection to any underlying socks, and can allow the improved sock display 200 to vertically support itself. FIGS. 7 and 8 depict side and front views of the improved sock display 200.

Figure 9:
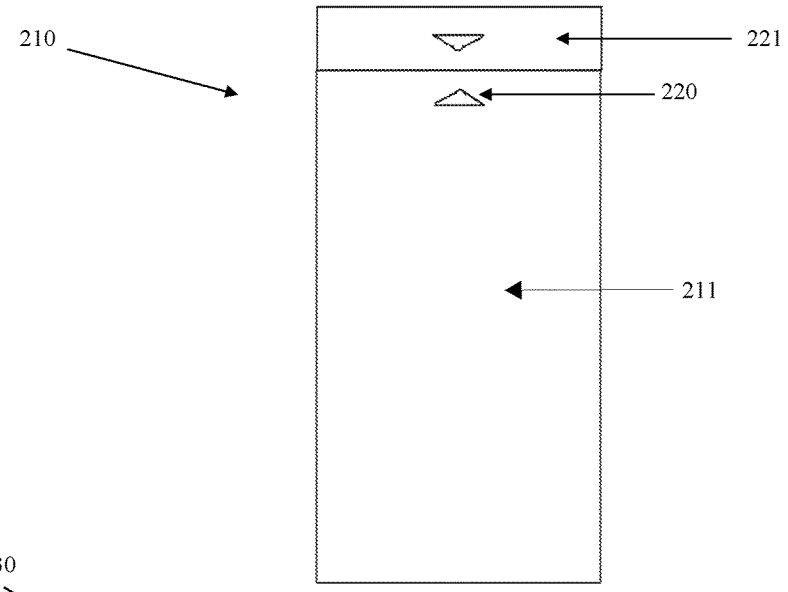
FIG. 9 depicts a front view of a backing structure according to one embodiment.

The improved sock display depicted in FIGS. 6 to 8 can be assembled by attaching a cascade support structure 230 to a backing structure 210. Examples of a backing structure 210 and a flat, unassembled, cascade support structure 230 are depicted in FIGS. 9 and 10 respectively.

Figure 10:
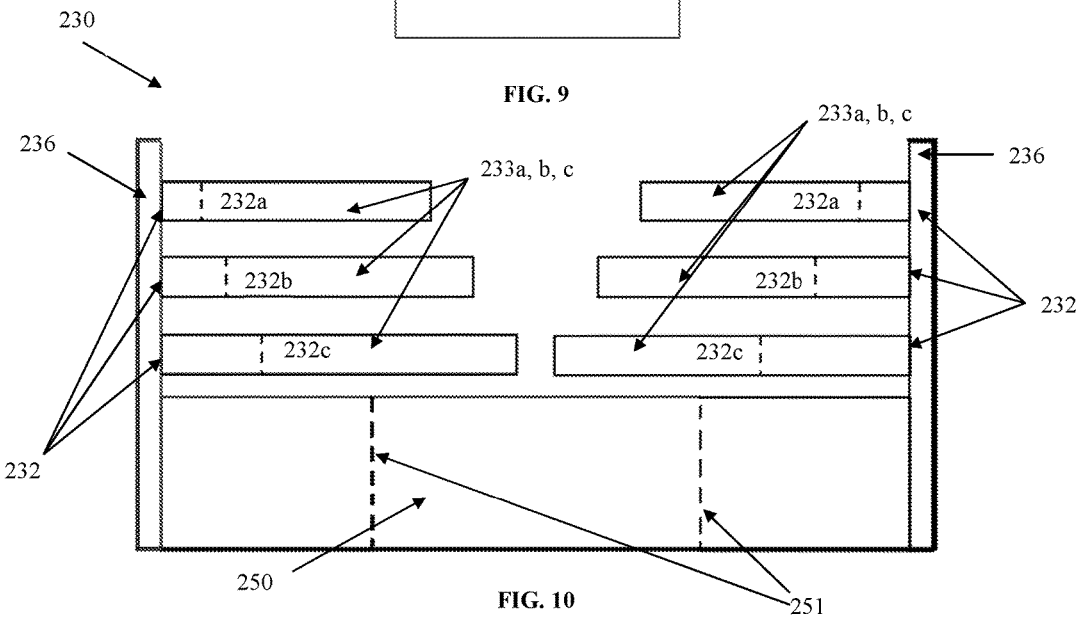
FIG. 10 depicts a front view of an unassembled cascade structure according to one embodiment.

As illustrated by FIG. 10, the cascade support structure 230 can require folding or assembly either before or after attachment to the backing structure 210. Steps required to assemble the cascade support structure 230 can include the steps of forming the display portion 250 by folding along lines 251, and assembling the sock support structures 235*a*, 235*b*, and 235*c* from distal members 233*a*, 233*b*, and 233*c* by folding along lines 232 and second fold lines 232*a*, 232*b*, and 232*c*. Sock support structures 235*a*, 235*b*, and 235*c* can be integrally formed and can be similar to sock support structures 5*a*, 5*b*, and 5*c* previously described with respect to FIGS. 4 and 5.

As can be appreciated, cascade support structure 230 can require a backing member because it has substantially no inherent front or back face after assembly. Attachment of the backing structure 210 can provide a front face 211 and back face (not depicted) to the improved sock display.

Generally, the backing structure 210 and the cascade support structure 230 can be attached to each other in a variety of ways. For example, the longitudinal edges 215 and 236 of the backing structure 210 and the cascade support structure 230 can be joined together by inserting strips of material from one of the structures into holes in the corresponding structure. Alternatively, a mechanical fastener such as a staple or grommet, or a suitable adhesive such as a pressure-sensitive adhesive can be used. As can be appreciated however, it can be preferable not to use mechanical fasteners or adhesives because such attachment methods require additional materials and can interfere with the recyclability of the sock display.

As can be further appreciated, although the mounting structure 210 and the cascading structure 230 are shown attached along their longitudinal edges 215 and 236, other attachment locations can also be utilized. For example, certain cascading support structures 230 can wrap around the back of a backing structure 210 and can be attached to a back face of the backing structure 210.

Figure 11:
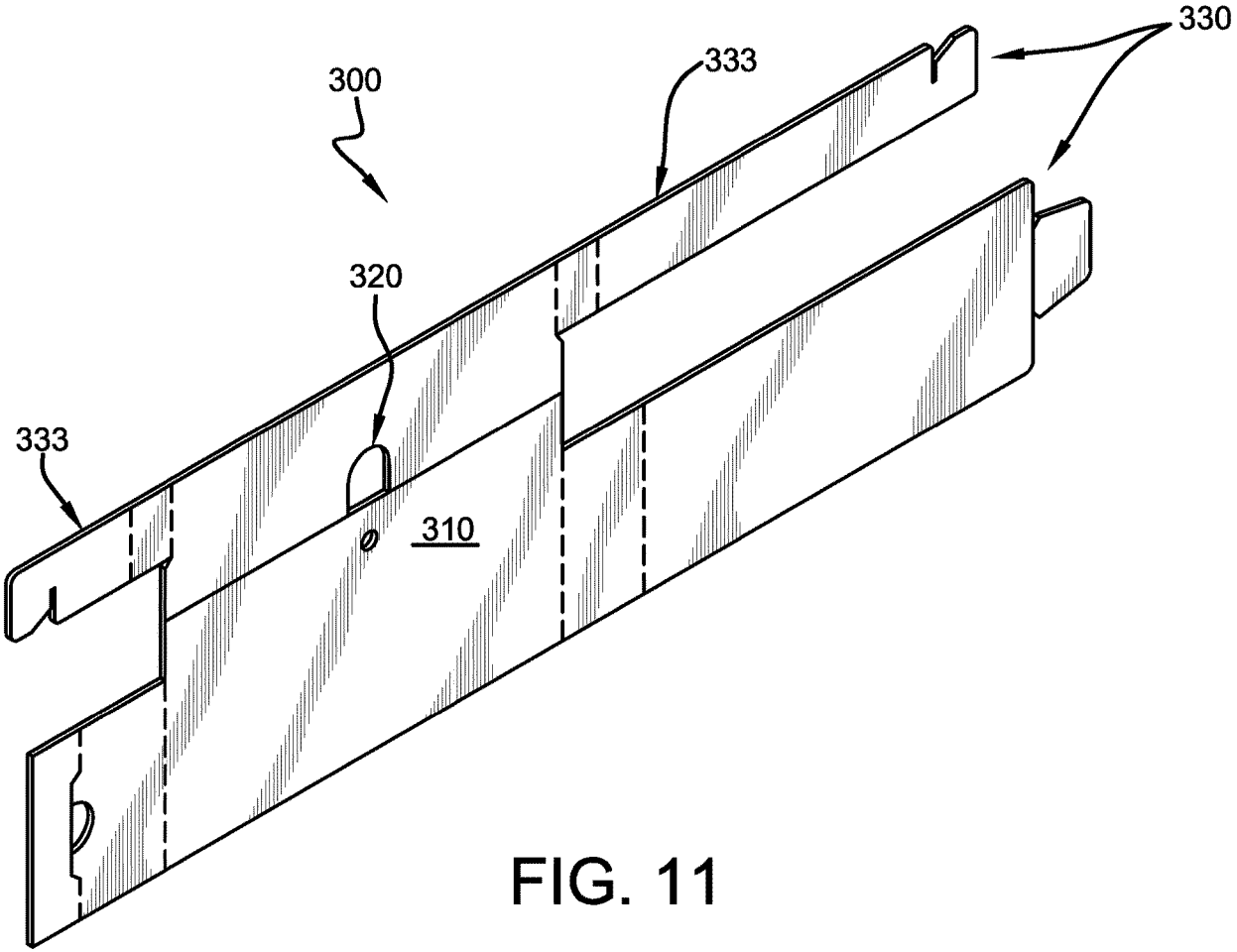
FIG. 11 depicts a perspective view of an unassembled cascading display according to one embodiment.
Figure 12:
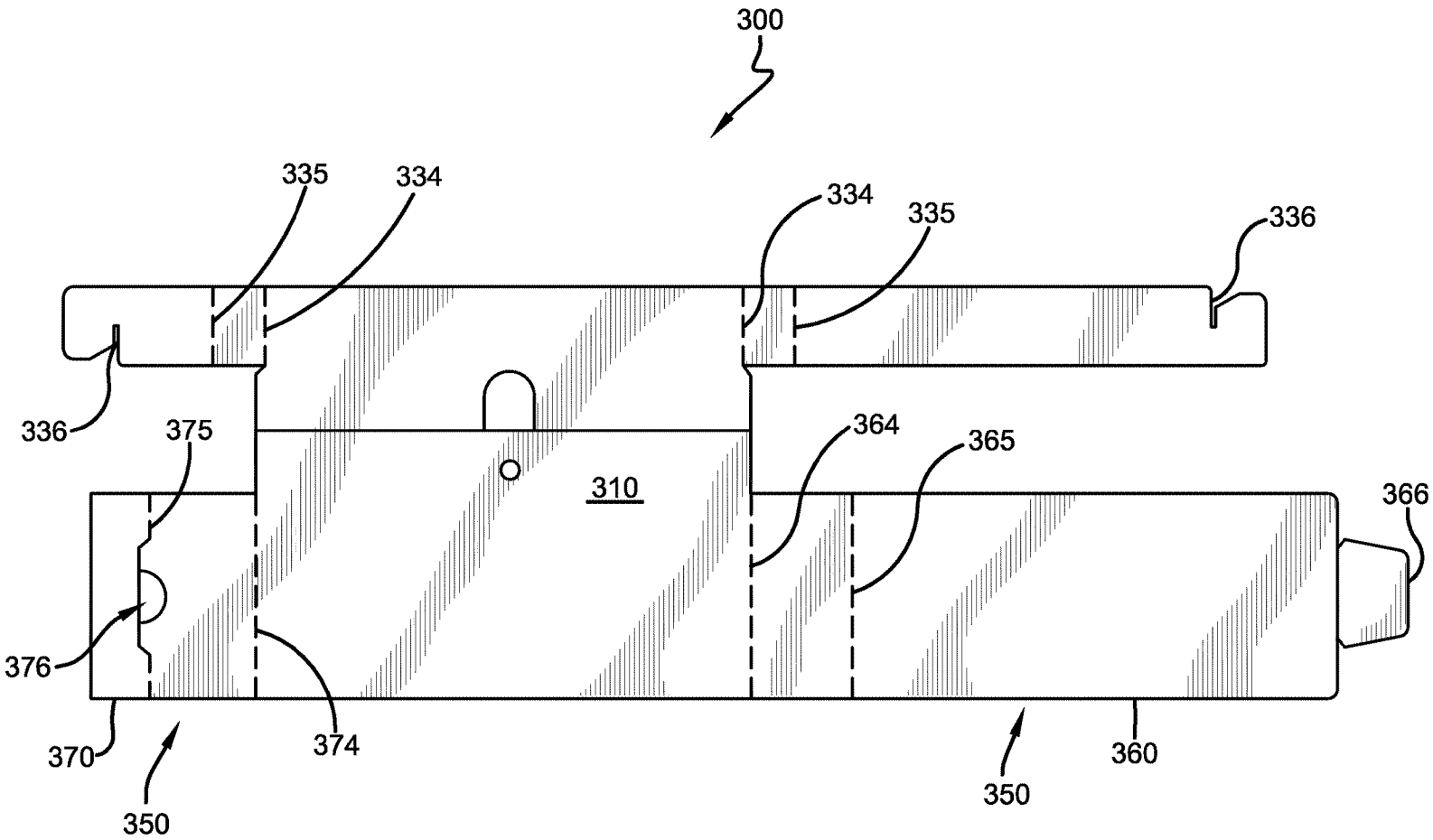
FIG. 12 depicts a front view of the unassembled cascading display depicted in FIG. 11.

FIGS. 11 and 12 disclose another exemplary embodiment of a cascading display 300 for use in displaying undergarments such boxers, briefs, thermal garments, and the like. The cascading display 300 comprises a front face 310 and a cascading support structure 330. The cascading display 300 may further comprise a hanger 320 incorporated into the front face 310 which may be optionally reinforced as described infra.

The cascading support structure 330 comprises at least one pair of distally extending members 333 integrally formed out of the front face 310, and similar to sock support structures 5*a*, 5*b*, and 5*c* previously described with respect to FIGS. 4 and 5. Each of the at least one pair of distally extending members 333 comprises a folded edge 334 and a second fold location 335 similar in configuration to the folded edge 2 and the second fold location 3*a*, 3*b*, and 3*c* of the cascade support structure 100 as described supra. While each at least one pair of distally extending members 333 may be connected to the other by any suitable attachment process, each at least one pair of distally extending members 333 may further comprise a slotted section 336 for attaching the at least one pair of distally extending members 333 together. Secure attachment is achieved by mating the slotted sections 336 sliding one into the other.

The cascading support structure 330 further comprises a display portion 350 comprising a first member 360 and a second member 370 each integrally formed out of the front face 310. The first member 360 comprises a folded edge 364 and a second fold location 365 similar in configuration to the fold along lines 251 of the cascade support structure 230 as illustrated in FIG. 10 and the folded edge 2 and the second fold location 3*a*, 3,*b*, and 3*c* of the cascade support structure 100 as described supra. The second member 370 similarly comprises a folded edge 374 and a second fold location 375.

While the first member 360 may be attached to the second member 370 by any suitable attachment process, the first member 360 may further comprise a tab 366 and the second member 370 may further comprise a tab insertion element 376. The tab insertion element 376 is typically a slot, hole, or similarly designed opening capable of mating with and retaining the tab 366 of the first member 360 to form the display portion 350 once connected. Additionally, as described supra regarding the embodiment illustrated in FIG. 4, once assembled, the width of the display portion 350 will be proportionally larger than that of a widest of the at least one pair of distally extending members 333. As such, each displayable undergarment will be readily visible in a cascading orientation.

The improved cascading displays disclosed herein can incorporate a variety of additional features. For example, a hanger 20 or 220 can be incorporated into a front face 10 or 211 to allow for an improved cascading display to be hung from a store shelf. In certain embodiments, a front face 10 or 211 can also include optional reinforcement for hanger 20 or 220. For example, a front face 10 or 211 can include a flap of additional material 221 which can be folded over to reinforce the hangar cutout. An example of such reinforcement is depicted in FIG. 9.

Radio-Frequency Identification ("RFID") tags can also be incorporated into the improved cascading display. RFID tags can allow factories and stores to quickly improve logistics and inventory management. A variety of suitable RFID tags can be obtained from the Avery Dennison Corporation (Clinton, S.C.).

The improved cascading displays disclosed herein can exhibit a number of beneficial improvements over known cascading displays. For example, the improved cascading displays can require less material than existing cascading displays and can be substantially formed of environmentally friendly materials such as paper, cardstock, cardboard, coated paper, and the like. Alternatively, a plastic material can be suitable. In certain embodiments, at least a portion of the material can also be sourced from post-consumer content.

As can be appreciated, the improved cascading displays can also require less components and fewer steps to assemble. For example, improved cascading garment displays as disclosed herein can be formed of only one or two components in certain embodiments.

Formation of the improved cascading displays from materials such as paper and cardstock can also allow for indicia to be formed on substantially any portion of the cascading display including the front face, back face, and display portions of the display. As can be appreciated, the flat nature of the unassembled improved cascading displays can allow for easier formation and customization of indicia because it enables printing of indicia using common and conventional printing techniques. The use of conventional printing techniques can also allow stores or factories to quickly produce customized indicia without great expense.

The improved cascading displays can also minimize the energy and expense required to ship sock displays to a store or factory. For example, the improved cascading displays can be shipped in a substantially flat geometry and can be assembled onsite allowing for more efficient shipping of the unassembled cascading display. Alternatively, the improved cascading displays can be quickly assembled at a factory using common materials such as cardstock. As can appreciated, the ability to flatten the improved cascading displays can also allow a consumer to reduce the volume of material to be recycled or thrown away after purchase of the socks, underwear, and other displayable garments.

The foregoing description and accompanying figures illustrate the principles, certain embodiments, and modes of operation of the invention. However, the invention should not be constructed as being limited to the particular embodiments disclosed above. Additional variations of the embodiments disclosed will be appreciated by those skilled in the art. Therefore, the above-disclosed embodiments should be regarded as illustrative rather than restrictive. Accordingly, it should be appreciated that variations to those embodiments can be made by those skilled in the art without departing from the scope of the invention as defined by the following claims.

What is claimed is:

1. A cascading sock display comprising:

a panel having a front face, a back face, a top edge, a bottom edge, opposed side edges, and a plurality of integrally formed distally extending members protruding outwardly from the respective side edges, wherein the plurality of distally extending members comprises laterally adjacent pairs of said distally extending members that are spaced vertically;

each laterally adjacent pair of distally extending members comprises an upwardly facing slot on one distally extending member of each laterally adjacent pair and the other distally extending member of each laterally adjacent pair comprises a downwardly facing slot;

where each laterally adjacent pair of distally extending members comprises distal ends, first folds near the respective side edges of the panel and second folds located between the first folds and the distal ends respectively;

wherein each laterally adjacent pair of distally extending members are folded at the first folds and folded at the second folds respectively to pivot the distal ends of each laterally adjacent pair of distally extending members toward each other to mate with one another through engagement of said upwardly facing slot with said downwardly facing slot respectively to form a sock support structure rail for hanging socks therefrom.

2. The cascading sock display of claim 1, further comprising a backing structure comprising the front face and wherein the sock support structure rails are attached to the backing structure.

3. The cascading sock display of claim 2, wherein the backing structure and the sock support structure rails are attached without adhesives or fasteners.

4. The cascading sock display of claim 2, further comprising an integrally formed display portion displaced away from the front face.

5. The cascading sock display of claim 4, further comprising indicia on one or more of the front face, the back face, and the integrally formed display portion.

6. The cascading sock display of claim 5, wherein the indicia comprises one or more of a price, a size, a descriptive text, a decorative element, and a barcode.

7. The cascading sock display of claim 1, wherein the front face further comprises a hangar hole.

8. The cascading sock display of claim 7, wherein the front face further comprises a reinforcement flap.

9. The cascading sock display of claim 1, further comprising an RFID tag.

10. The cascading sock display of claim 1, wherein the sock support structure rails comprise five sock support structure rails.

11. The cascading sock display of claim 1, wherein each sock support structure rail has a width substantially equivalent to two adjacent pairs of socks.

12. The cascading sock display of claim 1, wherein the panel is fabricated from paper, coated paper, cardstock, or cardboard.

13. The cascading sock display of claim 12, wherein the cardstock or the cardboard comprises indicia.

14. The cascading sock display of claim 1, wherein each of the sock support structures rails are vertically spaced apart along the front face and extend away from the front face; and wherein the sock support structures rails increase in length along a height of the front face.

* * * * *